US006644932B2

(12) United States Patent
Kelm et al.

(10) Patent No.: US 6,644,932 B2
(45) Date of Patent: Nov. 11, 2003

(54) HYBRID ELECTRIC/MECHANICAL COMPRESSOR WITH GEAR REDUCER

(75) Inventors: Brian Robert Kelm, Northville, MI (US); Robert John Mohrmann, Pinckney, MI (US); Richard Eric Luken, Farmington Hills, MI (US); Stephen Kempfer, Canton, MI (US); Shawn Harold Swales, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 0 days.

(21) Appl. No.: 10/003,783

(22) Filed: Nov. 15, 2001

(65) Prior Publication Data

US 2003/0091444 A1 May 15, 2003

(51) Int. Cl.[7] ..... F04B 49/00; B60K 1/00; B60K 41/02

(52) U.S. Cl. ..... 417/212; 417/410.1; 417/374; 180/65.2; 477/5; 62/157

(58) Field of Search ..... 417/212, 269, 417/415, 410.1, 222.2, 374; 62/157; 180/65.2; 477/5

(56) References Cited

U.S. PATENT DOCUMENTS

| | | | | |
|---|---|---|---|---|
| 2,725,825 A | | 12/1955 | Cibattari | 417/120 |
| 2,888,810 A | | 6/1959 | Hann | 62/215 |
| 2,902,205 A | | 9/1959 | Parker | 417/319 |
| 3,861,484 A | * | 1/1975 | Joslin | 180/65.2 |
| 5,275,011 A | * | 1/1994 | Hanson et al. | 62/157 |
| 5,772,407 A | * | 6/1998 | Kato et al. | 417/269 |
| 6,176,808 B1 | * | 1/2001 | Brown et al. | 477/5 |
| 6,234,769 B1 | * | 5/2001 | Sakai et al. | 417/374 |
| 6,443,712 B2 | * | 9/2002 | Sakai et al. | 417/374 |
| 6,494,277 B1 | * | 12/2002 | Boggs et al. | 180/65.2 |

FOREIGN PATENT DOCUMENTS

| | | |
|---|---|---|
| JP | 11-287182 | * 10/1999 |

* cited by examiner

*Primary Examiner*—Cheryl J. Tyler
*Assistant Examiner*—Michael K. Gray
(74) *Attorney, Agent, or Firm*—Brinks Hofer Gilson & Lione

(57) ABSTRACT

A system for driving a compressor is disclosed. The system includes an internal combustion engine in communication with the compressor for selectively driving an input shaft of the compressor; an electric motor in communication with the compressor for selectively driving the compressor when the compressor is not being driven by the engine; and a gear assembly operatively connected to a motor output of the electric motor shaft for changing a rotational speed of the motor output shaft.

19 Claims, 2 Drawing Sheets

HYBRID ELECTRIC/MECHANICAL COMPRESSOR WITH GEAR REDUCER

BACKGROUND OF THE INVENTION

The present invention relates to AC compressors and systems and methods for driving the AC compressor using an electric motor and an internal combustion engine.

BACKGROUND ART

Hybrid compressor systems having an electric motor and an internal combustion engine coupled to an AC compressor have gained widespread interest, especially in the automotive environment. Typically, an AC compressor is driven by an automobile's engine during engine operation. When the engine is not operating, an electric motor is used to drive the compressor. Generally, the engine is coupled to the compressor through a drive belt and clutch mechanism. The electric motor, however, is typically coupled to the AC compressor via a solid shaft.

While conventional systems for driving AC compressors achieve their intended purpose, many problems still exist. For example, while the engine is operating and therefore driving the AC compressor, the electric motor being attached to the AC compressor through a solid shaft is also turning. The rotation of the electric motor while the AC compressor is driven by the engine not only decreases efficiency of the overall system by adding additional load on the engine but also increases wear of the electric motor.

Other problems not resolved by the prior art include having to choose from a limited selection of electric motors having a desired torque output to drive the AC compressor. Disadvantageously, the electric motor needed to develop the required torque is costly and adds significant weight to the vehicle.

Therefore, what is needed is a new and improved system and method for driving an AC compressor. The new and improved system and method must increase the efficiency of the overall system and reduce wear. Moreover, the new and improved system and method must reduce the torque requirements of the electric motor, thereby reducing cost and weight of the overall system.

BRIEF SUMMARY OF THE INVENTION

In accordance with an aspect of the present invention, a new and improved system and method for driving an AC compressor is provided. The system and method of the present invention eliminates the problems stated above by introducing a clutch mechanism between an electric motor and an AC compressor.

In accordance with another aspect of the present invention, a system for driving a compressor is provided. The system has an internal combustion engine in communication with the compressor for selectively driving an input shaft of the compressor, an electric motor in communication with the compressor for selectively driving the compressor when the compressor is not being driven by the engine, and a gear assembly operatively connected to a motor output of the electric motor shaft for changing a rotational speed of the motor output shaft.

In accordance with another aspect of the present invention, further having a clutch positioned between the gear assembly and the compressor for decoupling the compressor from the motor when the engine is driving the compressor.

In accordance with yet another aspect of the present invention, the clutch is a one-way clutch.

In accordance with yet another aspect of the present invention, the clutch is an electric clutch.

In accordance with yet another aspect of the present invention, the gear assembly further comprises a sun gear and a planetary gear.

In accordance with yet another aspect of the present invention, the sun gear is fixed to the motor output shaft.

In accordance with yet another aspect of the present invention, the gear assembly further includes a planetary gear carrier.

In accordance with yet another aspect of the present invention, the planetary gear is rotatably fixed to the carrier.

In accordance with yet another aspect of the present invention, the carrier is fixed to a stationary gear case that houses the gear assembly.

In accordance with yet another aspect of the present invention, a ring gear wherein the ring gear is fixed to the compressor input shaft.

In accordance with yet another aspect of the present invention, the carrier is configured for slideable engagement with the ring gear.

In accordance with yet another aspect of the present invention, a system for driving a compressor is provided. The system has an internal combustion engine, an electric motor, a gear assembly, and a clutch. The internal combustion engine is in communication with a compressor for selectively driving an input shaft of the compressor. The electric motor is in communication with the compressor for selectively driving the compressor when the compressor is not being driven by the engine. The gear assembly is operatively connected to a motor output shaft of the electric motor for changing a rotational speed of the motor output shaft. The clutch is positioned between the gear assembly and the compressor for decoupling the compressor from the motor when the engine is driving the compressor.

Further objects, features and advantages of the invention will become apparent from consideration of the following description and the appended claims when taken in connection with the accompanying drawings.

DETAILED DESCRIPTION OF THE INVENTION

Figure 1:
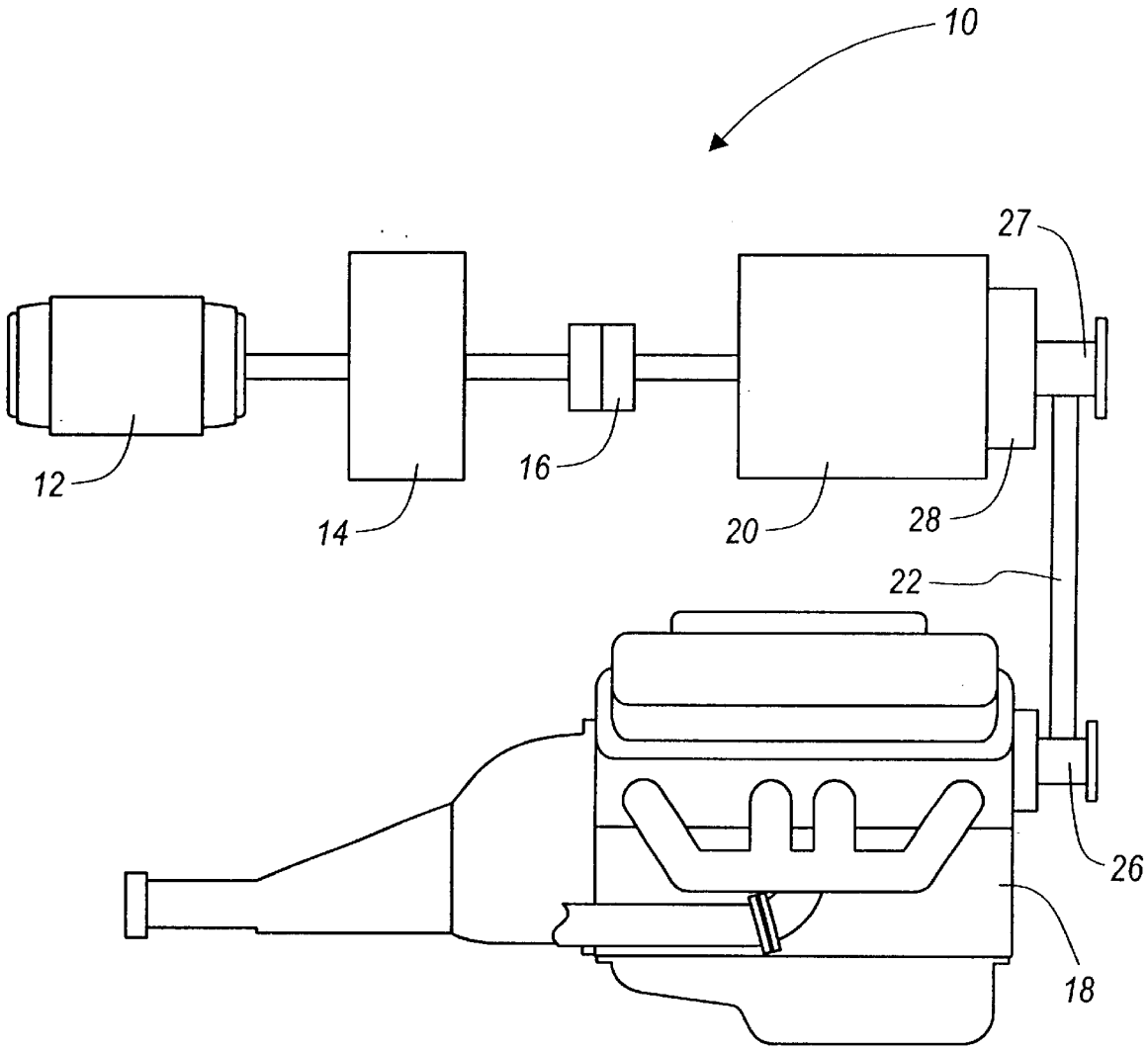
FIG. 1 is a schematic diagram of a AC compressor drive system for selectively driving an AC compressor with an electric motor and an internal combustion engine, in accordance with the present invention.

Referring now to FIG. 1, a schematic diagram of a AC compressor drive system 10 for powering a compressor is illustrated, in accordance with the present invention. Compressor drive system 10 includes an electric motor 12, a gear box 14, an electric motor clutch mechanism 16, and an engine 18. Electric motor 12 and engine 18 selectively drive a compressor 20.

For example, when engine 18 is not operating, electric motor 12 drives compressor 20. However, when the engine 18 is operating, the engine drives compressor 20.

Electric motor 12 is coupled to compressor 20 through gear box 14 and clutch 16. The specific features and components of gear box 14 will be described hereinafter. Gear box 14 allows a wider varieties of electric motors to be used to drive AC compressor 20 by reducing the torque output requirements that electric motor 12 must deliver to compressor 20. Electric motor clutch 16 allows the electric motor 12 to be selectively engaged or disengaged to compressor 20.

Engine 18 is coupled to compressor 20 through a drive belt 22 and a motor pulley 26 and a compressor pulley 27. When the engine is not driving compressor 20, an engine clutch mechanism 28 disengages the drive belt 22 and thus engine 18 from compressor 20.

Accordingly, the present invention reduces load on the engine by disengaging the electric motor 12 when the engine 18 is driving the compressor 20 and therefore increases the efficiency of system 10.

Figure 2:
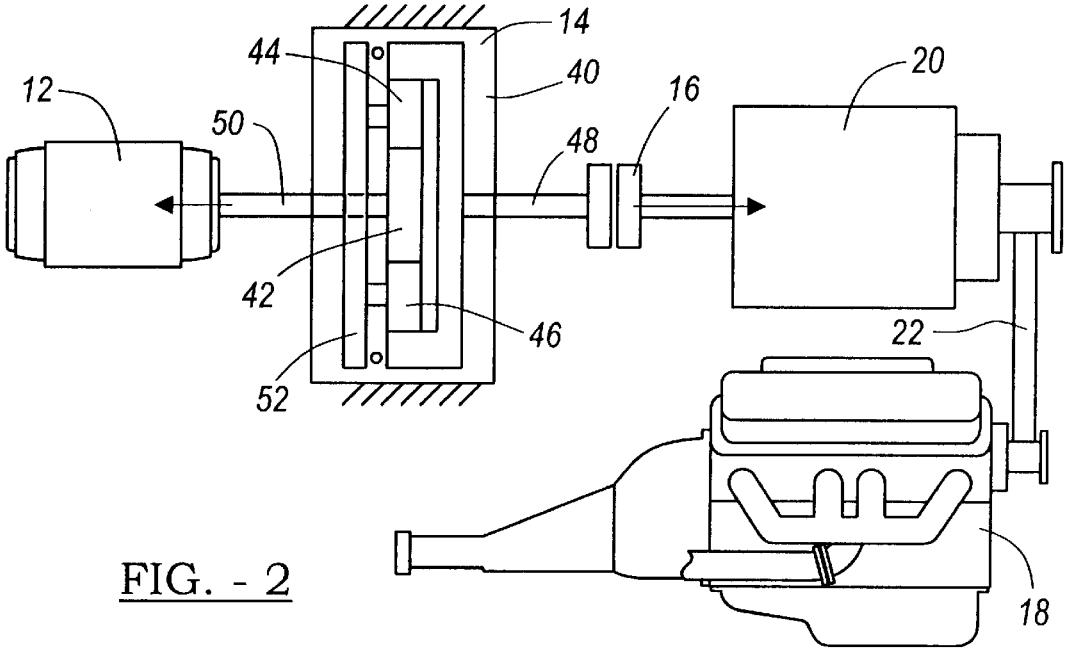
FIG. 2 is a schematic diagram of a preferred embodiment of a system for driving an AC compressor, in accordance with the present invention.

Referring now to FIG. 2, a preferred embodiment of system 10 is further illustrated, in accordance with the present invention. Gear box 14 includes a ring gear 40, a sun gear 42 and a pair of planetary gears 44 and 46. Ring gear 40 is coupled to clutch mechanism 16 via a solid shaft 48, while sun gear 42 is coupled to electric motor 12 via a solid shaft 50. Planetary gears 44 and 46 are rotatably attached to a carrier 52 that is in turn fixedly attached to shaft 50. Alternatively, more than 2 planetary gears may be used, for example 3 planetary gears my be utilized in an embodiment of the present invention.

Gear mechanism 14 allows various motors to be selected to operate at different speeds to produce the required power output. More specifically, a motor having a reduced torque output may be used by amplifying the speed of motor output with an appropriate gear arrangement. For example, the gear mechanism shown in FIG. 2 may be operated to amplify or reduce the compressor input by rotating the carrier and thus the planetary gears about the sun gear 42 and fixing the carrier to the case. Further, gear mechanism 14 may be operated to rotate the compressor input shaft at the same rate of rotation of the motor output shaft by fixing the carrier 52 to the ring gear 40.

Figure 3:
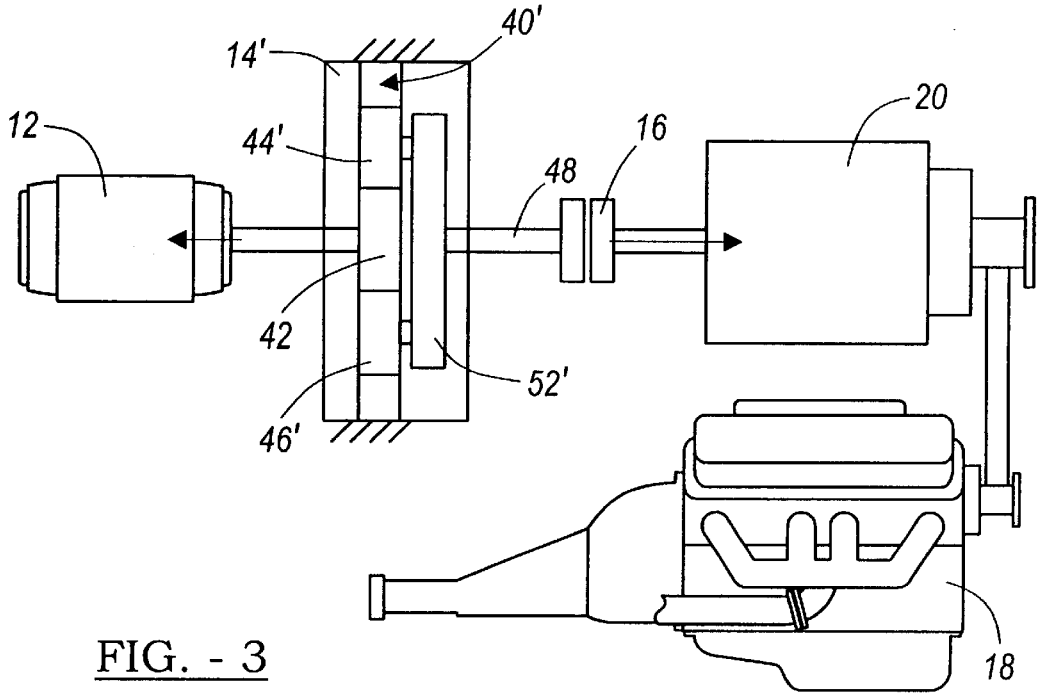
FIG. 3 is a schematic diagram of another embodiment of a system for driving an AC compressor, in accordance with the present invention.

Referring now to FIG. 3, another embodiment of the present invention is illustrated. The compressor drive system of FIG. 3 includes a gear mechanism 14' having a fixed ring gear 40' and a carrier 52' fixed to the compressor input shaft 48. Carrier 52' has two planetary gears 44' and 46' rotatably attached thereto. In an alternate embodiment of the present invention more than two planetary gears may be used, for example three planetary gears may be used. The gear arrangement in FIG. 3, allows the motor to operate with a lower torque requirement at a higher speed and deliver the same power to the compressor than a motor operating at a lower speed and higher torque, powering the compressor directly.

Accordingly, the present invention has many advantages and benefits of the prior art. For example, the present invention provides a means for selecting a variety of electrical motors to drive the AC compressor in the most cost effective and weight conscious way. Moreover, the present invention provides a means for decoupling the electric motor from the compressor when the engine is operating thereby increasing the overall efficiency of the system and reducing wear on the electric motor 12.

The foregoing discussion discloses and describes a preferred embodiment of the invention. One skilled in the art will readily recognize from such discussion, and from the accompanying drawings and claims, that changes and modifications can be made to the invention without departing from the true spirit and fair scope of the invention as defined in the following claims.

What is claimed is:

1. A system for driving a compressor, the system comprising:

an internal combustion engine connected to the compressor for selectively driving an input shaft of the compressor;

an electric motor connected to the compressor for selectively driving the compressor when the compressor is not being driven by the engine;

a gear assembly operatively connected to a motor output shaft of the electric motor and to the input shaft of the compressor for changing a rotational speed of the motor output shaft; and a clutch positioned between the pear assembly and the compressor for decoupling the compressor from the motor when the engine is driving the compressor.

2. The system of claim 1 wherein the clutch is a one-way clutch.

3. The system of claim 1 wherein the clutch is an electric clutch.

4. The system of claim 1 wherein the gear assembly further comprises a sun gear and a planetary gear.

5. The system of claim 4 wherein the sun gear is fixed to the motor output shaft.

6. The system of claim 4 wherein the gear assembly further comprises a planetary gear carrier.

7. The system of claim 6 wherein the planetary gear is rotatably fixed to the carrier.

8. The system of claim 6 wherein the carrier is fixed to a stationary gear case that houses the gear assembly.

9. The system of claim 6 further comprising a ring gear wherein the ring gear is fixed to the compressor input shaft.

10. The system of claim 9 wherein the carrier is configured for slideable engagement with the ring gear.

11. A system for driving a compressor, the system comprising:

an internal combustion engine connected to the compressor for selectively driving an input shaft of the compressor;

an electric motor connected to the compressor for selectively driving the compressor when the compressor is not being driven by the engine;

a means for changing a rotational speed of the motor output shaft operatively connected to a motor output shaft of the electric motor; and a means for decoupling positioned between the means for changing a rotational speed and the compressor for decoupling the compressor from the motor when the engine is driving the compressor.

12. The system of claim 11 wherein the means for changing a rotational speed of the motor output further comprises a sun gear and a planetary gear.

13. The system of claim 12 wherein the sun gear is fixed to the motor output shaft.

14. The system of claim 12 the means for changing a rotational speed of the motor output further comprises a planetary gear carrier.

15. The system of claim 14 wherein the planetary gear is rotatably fixed to the carrier.

16. The system of claim 14 further comprising a ring gear is fixed to a stationary gear case that houses the means for changing a rotational speed of the motor output.

17. The system of claim 14 further comprising a earner wherein the carrier is fixed to the compressor input shaft.

18. The system of claim 11 wherein the means for decoupling is a one-way clutch.

19. The system of claim 11 wherein the means for decoupling is an electric clutch.

* * * * *

UNITED STATES PATENT AND TRADEMARK OFFICE

CERTIFICATE OF CORRECTION

PATENT NO. : 6,644,932 B2
DATED : November 11, 2003
INVENTOR(S) : Brian R. Kelm et al.

It is certified that error appears in the above-identified patent and that said Letters Patent is hereby corrected as shown below:

Column 4,
Line 60, after "claim 12" insert -- wherein --.
Line 66, before "fixed" delete "is".

Column 5,
Line 1, delete "earner" and substitute -- carrier -- in its place.

Signed and Sealed this

Sixteenth Day of March, 2004

JON W. DUDAS
*Acting Director of the United States Patent and Trademark Office*